US010619301B2

(12) United States Patent
Paavolainen

(10) Patent No.: US 10,619,301 B2
(45) Date of Patent: Apr. 14, 2020

(54) INDUSTRIAL TEXTILE, A METHOD FOR MEASURING A CONDITION ON THE SURFACE OF THE INDUSTRIAL TEXTILE AND A USE OF THE INDUSTRIAL TEXTILE

(71) Applicant: Valmet Technologies Oy, Espoo (FI)

(72) Inventor: Juha Paavolainen, Kangasala (FI)

(73) Assignee: VALMET TECHNOLOGIES OY, Espoo (FI)

( * ) Notice: Subject to any disclaimer, the term of this patent is extended or adjusted under 35 U.S.C. 154(b) by 99 days.

(21) Appl. No.: 15/940,392

(22) Filed: Mar. 29, 2018

(65) Prior Publication Data

US 2018/0291557 A1 Oct. 11, 2018

(30) Foreign Application Priority Data

Apr. 5, 2017 (FI) ..... 20175315

(51) Int. Cl.

| | |
|---|---|
| ***D21F 7/12*** | (2006.01) |
| ***D03D 1/00*** | (2006.01) |
| ***D21F 7/00*** | (2006.01) |

(52) U.S. Cl.

CPC ..... *D21F 7/12* (2013.01); *D03D 1/0094* (2013.01); *D21F 7/003* (2013.01); *D03D 2700/02* (2013.01); *D10B 2505/00* (2013.01)

(58) Field of Classification Search

None

See application file for complete search history.

(56) References Cited

U.S. PATENT DOCUMENTS

| | | | |
|---|---|---|---|
| 2006/0060323 | A1 | 3/2006 | Westerkamp et al. |
| 2016/0083906 | A1 | 3/2016 | Hill et al. |

FOREIGN PATENT DOCUMENTS

| | | |
|---|---|---|
| DE | 102008024952 | 11/2009 |
| DE | 102011006136 | 9/2012 |
| WO | WO2012085338 | 6/2012 |
| WO | WO2012117160 | 9/2012 |

OTHER PUBLICATIONS

Machine translation of DE102008024952, European Patent Office, [online], retrieved from the Internet, [retrieved Aug. 31, 2019], <URL: https://worldwide.espacenet.com/?locale=EN_ep>. (Year: 2019).*

"Non-reversible Temperature Labels", Omega, [online], retrieved from the Internet, 7 pages,[retrieved Aug. 31, 2019], <URL: https://www.omega.com/en-us/sensors-and-sensing-equipment/temperature/temperature-indicators/temperature-indicating-labels/p/TL-10>. (Year: 2003).*

Smook, Gary A., Handbook for Pulp and Paper Technologists, 2nd ed, Angus Wilde Publications, 1992, pp. 324. (Year: 1992).*

* cited by examiner

*Primary Examiner* — Dennis R Cordray

(74) *Attorney, Agent, or Firm* — Leason Ellis LLP

(57) ABSTRACT

The present invention relates to an industrial textile (1) for a drying process. The industrial textile (1) comprises a first surface (P) and a second surface (R); and longitudinal edge portions (EP1, EP2) and a centre portion (MP) between the edge portions (EP). The industrial textile comprises a sensor (2, 4). The present invention also relates to a method for measuring a condition on a surface of the industrial textile (1) and a use of the industrial textile (1).

7 Claims, 1 Drawing Sheet

INDUSTRIAL TEXTILE, A METHOD FOR MEASURING A CONDITION ON THE SURFACE OF THE INDUSTRIAL TEXTILE AND A USE OF THE INDUSTRIAL TEXTILE

CROSS-REFERENCE TO RELATED PATENT APPLICATIONS

The present application claims priority under 35 U.S.C. § 119 to Finnish Patent Application No. 20175315, filed Apr. 5, 2017, which is hereby incorporated by reference in its entirety.

FIELD OF THE INVENTION

The present invention relates to an industrial textile for a drying process, the industrial textile comprising a first surface and a second surface; and longitudinal edge portions and a centre portion between the edge portions. The present invention also relates to a method for measuring a condition on a surface of an industrial textile supporting material to be dried in a drying process and a use of the industrial textile.

BACKGROUND OF THE INVENTION

Disadvantages associated with the measurements that take place on the drying section of the paper machine are numerous. The measurements are limited to the front side of the drying section of the paper machine with an open or a closed hood. The time-consuming measurements require equipment, which is difficult to carry, and at least two trained persons who must work in physically straining conditions. The rotating ropes and rolls with the closing nips, bad visibility and heat threaten the work safety. Further, the persons have difficulties to move due to the protective clothing that they have to wear, the heavy equipment and the construction of the paper machine. For the above-mentioned reasons, the measurements are extremely expensive.

BRIEF DESCRIPTION OF THE INVENTION

An object of the present invention is to provide a method and an industrial textile for implementing the method so as to solve the above problems. The objects of the invention are achieved by the method and the industrial textile which are characterized by what is stated in the independent claims. The preferred embodiments of the invention are disclosed in the dependent claims.

Advantages of the present invention are remarkable. In the following, the advantages of the invention are explained and one should understand that they may exist in different combinations in the embodiments of the invention.

One important embodiment of the invention is to use it on a drying section of a paper, pulp or board machine. It is possible to use either the front or the back side of the machine to the measurements. The measurements can be made so that the hood is closed. No special equipment is required. The measurement is easy, quick and safe. Only one person can accomplish the preparations of the measurements and further, any special knowledge is not necessary in order to make those preparations. Furthermore, any special knowledge is not necessary for reading the measurement results.

The invention is based on the idea that the measurements can be made while the machine is running and the condition, e.g. temperature or relative humidity, can be read after a stoppage. The invention is useful for gathering data from the paper machine or the like in order to adapt the data to the future development of the industrial textiles or the development of the whole process at the paper machine. Furthermore, one can use the gathered data for estimating the remaining lifetime of the industrial textile or for deciding if the industrial textile needs to be changed.

The method for measuring a condition on a drying section of a paper machine comprises the following steps: Providing the industrial textile with a sensor, letting the drying section of the paper machine to run a period until a stoppage, and reading the condition. In other words, the sensor is attached to an immobile industrial textile or integrated in the industrial textile during manufacturing of the industrial textile while the measurement takes place at the same time when the paper machine is on and the industrial textile rotates.

The industrial textile may be a fabric of the drying section, i.e. an industrial textile conveying or being in contact with the paper, pulp or board web, such as a felt or a wire. The industrial textile may be a woven fabric. The industrial textile usually works as a loop circulating around certain rolls on the paper machine. The industrial textile comprises a first surface and a second surface and longitudinal edge portions and a centre portion between the edge portions. The web to be conveyed or contacted lies on the centre portion on the first surface and the edge portions of the industrial textile remain uncovered by the paper web. At least one sensor is attached to at least one edge portion of the industrial textile, i.e. the sensor may be attached to the edge of the industrial textile on the front side of the paper machine, or it may be attached to the edge of the industrial textile on the back side of the paper machine. The sensor may be placed on the first or the second surface of the industrial textile, i.e. the sensor may be placed on either surface of the industrial textile.

The sensor measures a condition prevailing on the drying section of the paper machine. The condition usually means temperature and/or relative humidity. The sensor may be a label reacting to a condition to be measured.

The label may be a label which measures temperature. The label works within a certain temperature range and the user have to select a suitable label covering the temperature range of interest. The label has a range of marks, each mark corresponding to a certain temperature range. The range of each mark is quite narrow, usually a few degrees of centigrade. When the temperature exceeds the range of the certain mark the mark changes its colour permanently.

According to another alternative, the label may be a label which measures relative humidity. The label has a range of marks, each mark corresponding to a certain range of the relative humidity. The range of each mark may be, for example, ten percentages of relative humidity. When the relative humidity exceeds the range of the certain mark the mark changes its colour permanently.

The method further comprises covering the sensor with a protective cover before starting the paper machine. The sensor, such as the label, may be covered with a protective cover in order to protect the sensor against heat, wear and enabling proper attachment of the sensor to the structural element. The protective cover may be an adhesive tape. The adhesive tape shall resist the temperature prevailing at the drying section, i.e. the adhesive tape shall be heat resistant and it shall stand at least 90° C., preferably at least 110° C.

One option to attach the sensor to the industrial textile is to make an opening to the industrial textile and place the sensor above or under the opening in such a manner that the sensor is arranged to sense the condition through the opening. The back side of the sensor, e.g. the label, is covered by the protective cover, e.g. the adhesive tape. Besides protecting the sensor, the protective cover secures the attachment of the sensor to the industrial textile. The above mentioned option may be useful especially in connection with measuring the relative humidity. However, the option can also be used with the temperature measurement.

The sensor may be attached to the industrial textile during the manufacture of the industrial textile, or it may be attached to the industrial textile when the industrial textile is already in use on the drying section. After the sensor is attached to the industrial textile, e.g. the label reacting to temperature and/or relative humidity is attached to the industrial textile, the paper machine is let to run a period of time until a stoppage. The stoppage is required to read the condition but one can exploit stoppages caused by other reasons, such as a shutdown for maintenance.

There are options for reading the condition. The condition can be read at the site e.g. by the staff at the paper machine, i.e. at the drying section without removing the sensor from the industrial textile, or the sensor can be removed from the industrial textile and sent forward to a further analysis. It is possible to cut off the sensor and a piece of the industrial textile underneath the sensor and send the sensor for a further analysis, e.g. a laboratory. Depending on the protective cover, it may be possible to read the condition through the cover, or the cover must be removed before reading the condition.

BRIEF DESCRIPTION OF THE DRAWINGS

In the following the invention will be described in greater detail by means of preferred embodiments with reference to the attached drawings, in which.

DETAILED DESCRIPTION OF THE INVENTION

Figure 1:
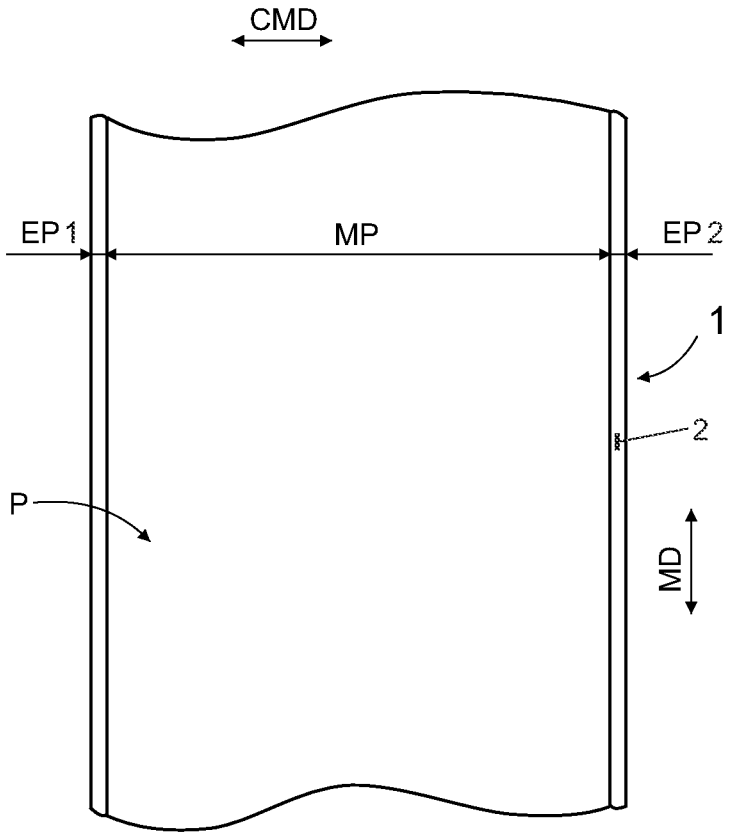
FIG. 1 shows an industrial textile from above.
Figure 2:
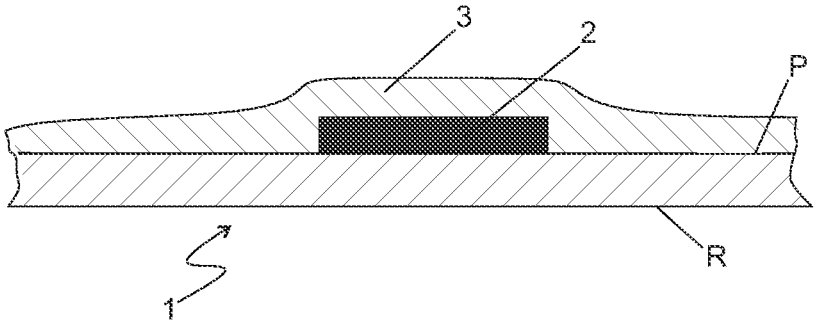
FIG. 2 the industrial textile of FIG. 1 as a cross-sectional view.

FIG. 1 shows an industrial textile 1 which comprises a first surface P and a second surface R (shown in FIG. 2). The industrial textile comprises longitudinal edge portions EP1 and EP2 and a centre portion MP between the edge portions EP1 and EP2. The cross direction of the industrial textile 1 is indicated by CMD and the longitudinal direction of the industrial textile 1 is indicated by MD. In connection with woven industrial textiles, the cross direction CMD is the weft direction and the longitudinal direction MD is the warp direction.

The edge portion EP2 comprises a sensor 2, e.g. a label reacting to a condition, such as temperature or relative humidity. Examples of such sensors are, among others, a temperature tape Thermostrip DC (LCR Hallcrest, Great Britain) and Maximum Humidity Indicator Cards (Telatemp, USA).

FIG. 2 shows the industrial textile 1 of FIG. 1 comprising the sensor 2 as a cross-sectional view. The sensor 2 is attached to the industrial textile 1, e.g. a wire or a felt. The sensor 2 is covered with a protective cover 3, e.g. an adhesive tape. Examples of the adhesive tapes are, among others, Fiberflect™ Tape AB (ADL Insulflex Inc, Canada) or Silicaflex™ Tape AB (ADL Insulflex Inc, Canada).

It will be obvious to a person skilled in the art that, as the technology advances, the inventive concept can be implemented in various ways. The invention and its embodiments are not limited to the examples described above but may vary within the scope of the claims.

The invention claimed is:

1. An industrial textile (1) for a drying process on a paper, board or pulp machine, the industrial textile (1) comprising a first surface (P) and a second surface (R); and longitudinal edge portions (EP1, EP2) and a centre portion (MP) between the edge portions, at least one of the edge portions (EP1, EP2) of the industrial textile comprises a sensor (2) wherein the sensor is a label reacting to the condition to be measured, the condition to be measured is temperature or relative humidity, and the label comprises a range of marks, each mark corresponding to a certain range of the condition to be measured in such a manner that when the condition to be measured exceeds the range of the certain mark, the mark changes its colour permanently.

2. The industrial textile according to claim 1, wherein at least one of the edge portions (EP1, EP2) comprise at least one sensor (2) attached to either surface (P, R) of the industrial textile (1).

3. The industrial textile according to claim 1, wherein the sensor (2) has a protective cover (3).

4. The industrial textile according to claim 3, wherein the protective cover (3) is a heat resistant adhesive tape.

5. A method for measuring a condition on a surface of an industrial textile (1), the industrial textile supporting a material to be dried in a drying process on a paper, board or pulp machine, comprising:

providing at least one of the edge portions (EP1, EP2) of the industrial textile with a sensor (2) which is a label reacting to the condition to be measured, the condition to be measured is temperature or relative humidity, and the label comprises a range of marks, each mark corresponding to a certain range of the condition to be measured in such a manner that when the condition to be measured exceeds the range of the certain mark, the mark changes its colour permanently, letting the drying process to run a period until a stoppage, and reading the condition during the stoppage.

6. The method according to claim 5, wherein the method further comprises covering the sensor (2) with a protective cover (3).

7. The method according to claim 6, wherein the sensor (2) is covered with a heat resistant adhesive tape.

* * * * *